US010082323B2

(12) United States Patent
Bae et al.

(10) Patent No.: US 10,082,323 B2
(45) Date of Patent: Sep. 25, 2018

(54) AIR CONDITIONER WITH USER CONTROL BETWEEN SIMULTANEOUS HEATING AND COOLING OPERATION AND ALTERNATING HEATING AND COOLING OPERATION

(71) Applicant: Samsung Electronics Co., Ltd., Gyeonggi-do (KR)

(72) Inventors: Dong Seok Bae, Gyeonggi-do (KR); Hyung Mo Koo, Gyeonggi-do (KR); Jin Young Ahn, Gyeonggi-do (KR); Hyun Jin Yoon, Gyeonggi-do (KR); Il Yong Cho, Gyeonggi-do (KR); Young Jun Choi, Gyeonggi-do (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 55 days.

(21) Appl. No.: 15/025,237

(22) PCT Filed: Sep. 22, 2014

(86) PCT No.: PCT/KR2014/008772
§ 371 (c)(1),
(2) Date: Mar. 25, 2016

(87) PCT Pub. No.: WO2015/046834
PCT Pub. Date: Apr. 2, 2015

(65) Prior Publication Data

US 2016/0238290 A1 Aug. 18, 2016

(30) Foreign Application Priority Data

Sep. 25, 2013 (KR) ..... 10-2013-0114081

(51) Int. Cl.
*F25B 13/00* (2006.01)
*F25B 41/04* (2006.01)
(Continued)

(52) U.S. Cl.
CPC ..... *F25B 41/04* (2013.01); *F24F 1/32* (2013.01); *F25B 13/00* (2013.01); *F25B 41/003* (2013.01);
(Continued)

(58) Field of Classification Search
CPC .. F25B 41/04; F25B 13/00; F25B 2313/0231; F25B 2313/02741; F24F 1/32
(Continued)

(56) References Cited

U.S. PATENT DOCUMENTS

2013/0019613 A1 1/2013 Lee et al.
2013/0104594 A1 5/2013 Lee

FOREIGN PATENT DOCUMENTS

CN 1793758 A 6/2006
CN 102889707 A 1/2013
(Continued)

OTHER PUBLICATIONS

International Search Report dated Jan. 9, 2015 in connection with International Application No. PCT/KR2014/008772, 5 pages.
(Continued)

*Primary Examiner* — Frantz Jules
*Assistant Examiner* — Steve Tanenbaum

(57) ABSTRACT

An air conditioner of the present invention includes: an outdoor unit having an outdoor heat exchanger and a compressor installed therein; a plurality of indoor units connected to the outdoor unit and having an indoor heat exchanger installed therein; a four-way valve provided on a discharge part side of the compressor; a refrigerant tube having first to third refrigerant tubes and connecting the four-way valve and the indoor heat exchanger, in which the first refrigerant tube is branched from between the four-way valve and the outdoor heat exchanger such that some of a refrigerant discharged from the compressor is fed into the
(Continued)

indoor heat exchanger while bypassing the outdoor heat exchanger, the second refrigerant tube is connected to the four-way valve to feed all of the refrigerant discharged from the compressor into the indoor heat exchanger, and the third refrigerant tube is connected to the second refrigerant tube in parallel; and a heat pump valve provided at the third refrigerant tube to selectively close the third refrigerant tube. The air conditioner includes an outdoor unit that can be applied to simultaneous cooling and heating concurrent type air conditioners and cooling and heating switching type air conditioners through the opening and closing of the heat pump valve.

17 Claims, 6 Drawing Sheets

(51) Int. Cl.
*F24F 1/32* (2011.01)
*F25B 41/00* (2006.01)
*F25B 49/02* (2006.01)

(52) U.S. Cl.
CPC ..... *F25B 49/02* (2013.01); *F25B 2313/0231* (2013.01); *F25B 2313/0252* (2013.01); *F25B 2313/02741* (2013.01); *F25B 2400/06* (2013.01); *F25B 2400/075* (2013.01); *F25B 2400/13* (2013.01); *F25B 2600/2501* (2013.01)

(58) Field of Classification Search
USPC ..... 62/324.6
See application file for complete search history.

(56) References Cited

FOREIGN PATENT DOCUMENTS

| | | | | | |
|---|---|---|---|---|---|
| EP | 1645810 | A2 | | 4/2006 | |
| EP | 1645810 | A3 | | 5/2006 | |
| EP | 2236957 | A2 | * | 10/2010 | ..... F25B 13/00 |
| JP | 195257 | A | | 4/1989 | |
| JP | 10-267428 | | | 10/1998 | |
| JP | 10267428 | A | | 10/1998 | |
| KR | 10-0447204 | | | 9/2004 | |
| KR | 100447204 | B1 | | 9/2004 | |
| KR | 1020050113322 | A | | 12/2005 | |
| KR | 100665744 | B1 | | 1/2007 | |
| KR | 10-0757969 | | | 9/2007 | |
| KR | 100791930 | B1 | | 12/2007 | |
| KR | 10-0791930 | | | 1/2008 | |
| KR | 10-2008-0025599 | | | 3/2008 | |
| KR | 20080025599 | A | * | 3/2008 | |
| KR | 1020080025599 | | | 3/2008 | |

OTHER PUBLICATIONS

Written Opinion of the International Searching Authority dated Jan. 9, 2015 in connection with International Application No. PCT/KR2014/008772, 5 pages.

The State Intellectual Property Office of P.R. China, "The First Office Action," Application No. 2014800532552, dated Apr. 24, 2017, 10 pages.

European Patent Office, "Supplementary European Search Report," Application No. EP14847465, dated May 19, 2017, 6 pages.

* cited by examiner

[Fig. 1]
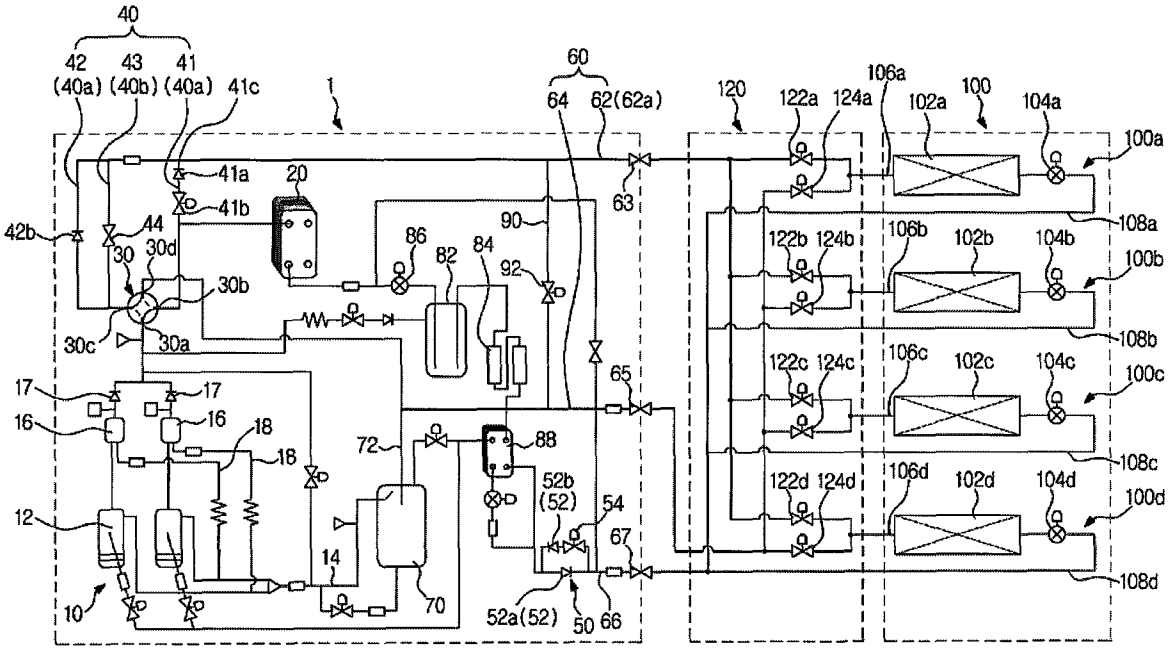

[Fig. 2]
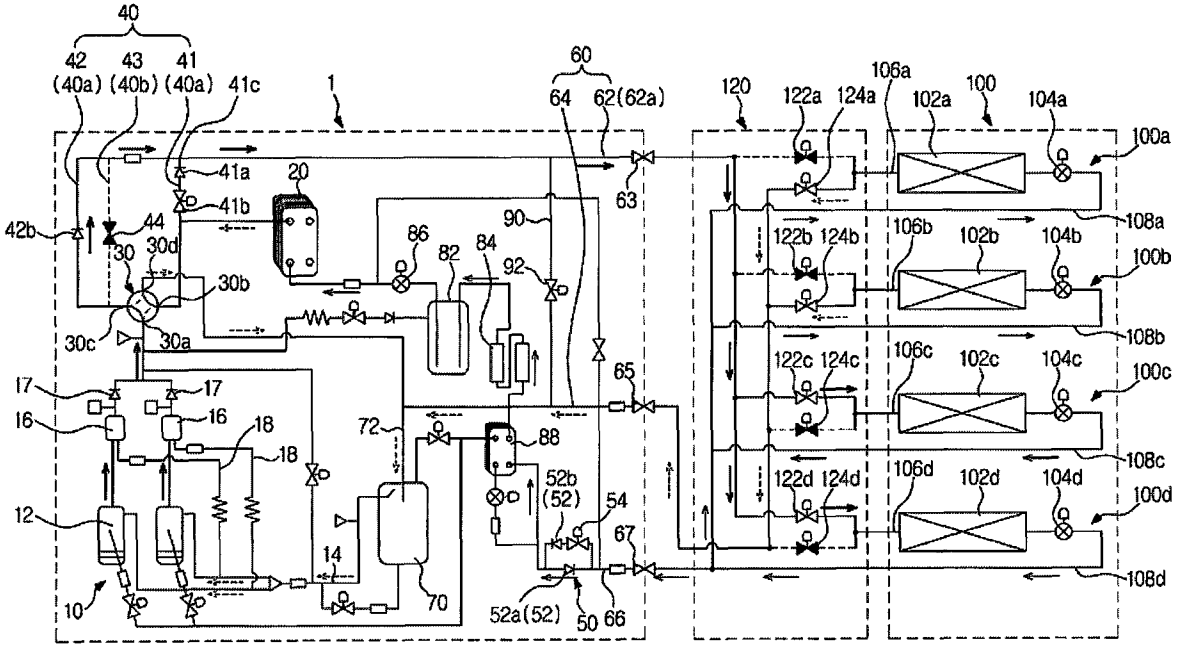

[Fig. 3]
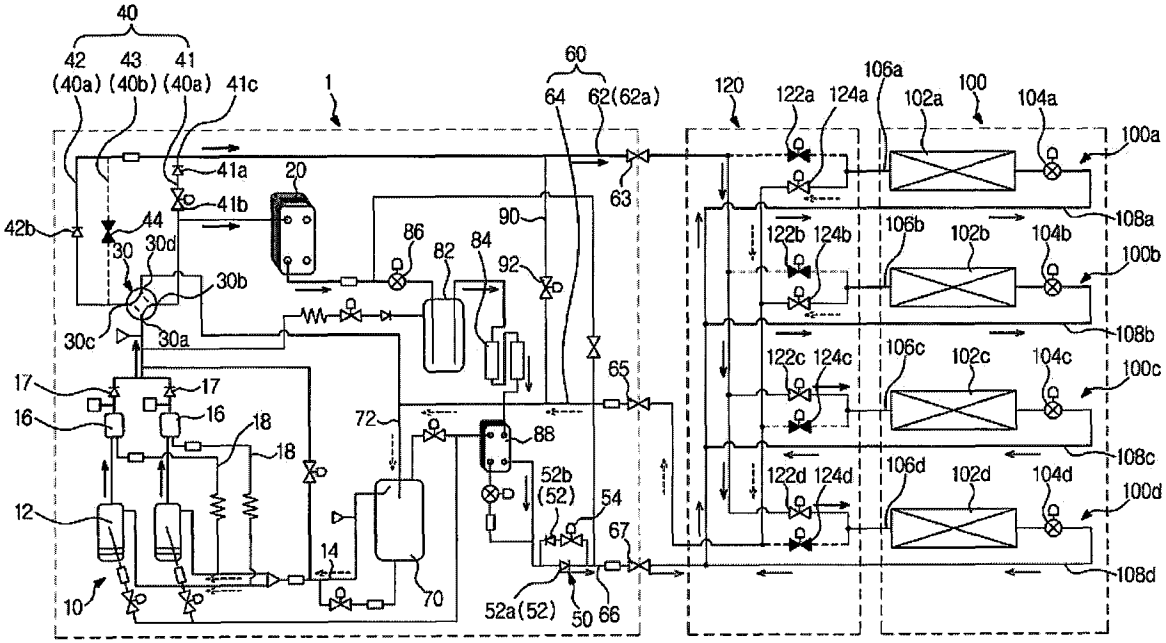

[Fig. 4]
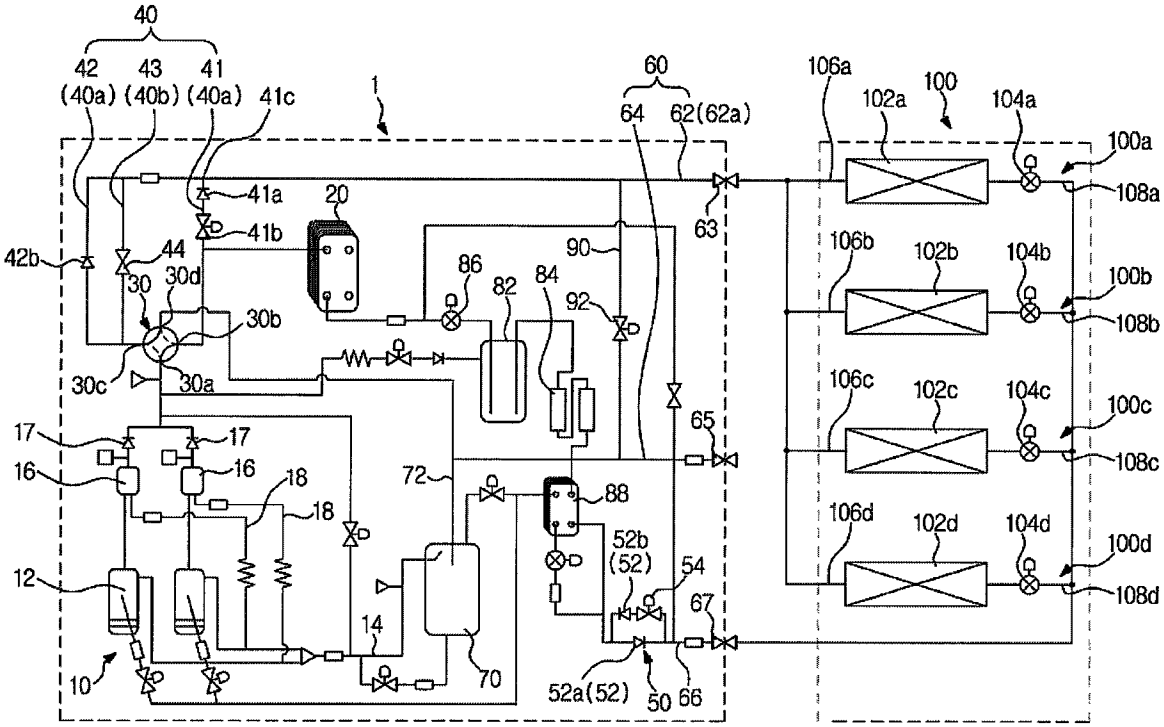

[Fig. 5]
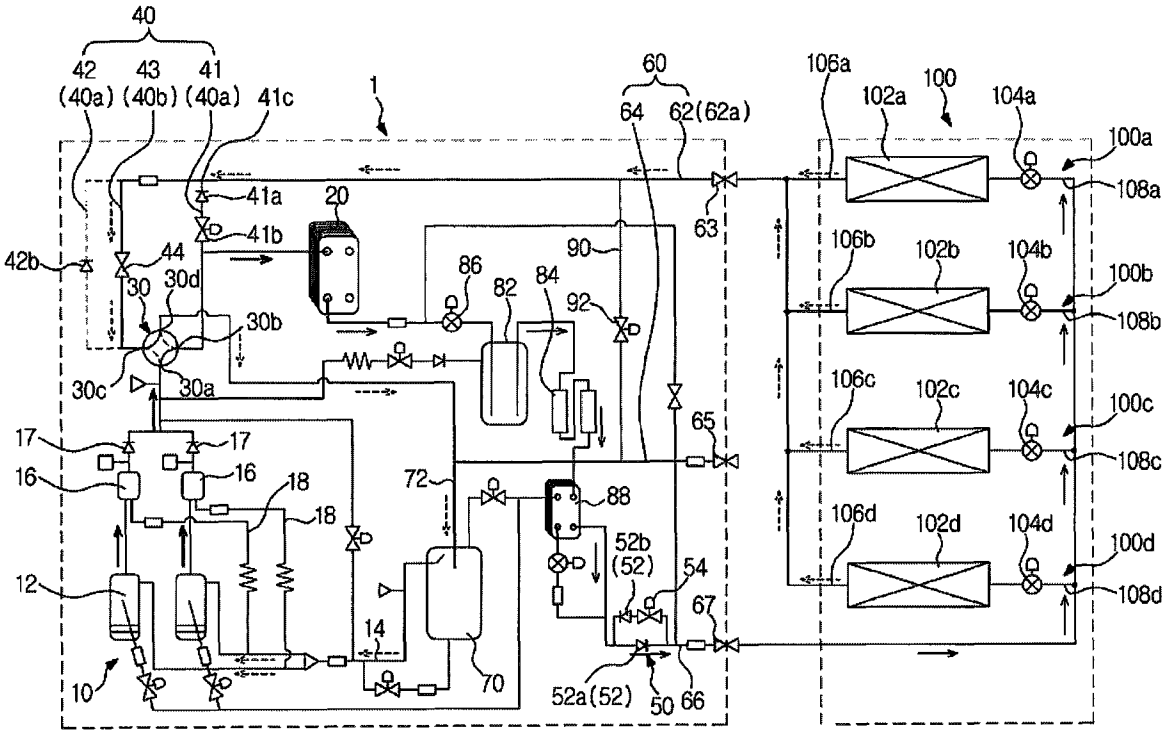

[Fig. 6]
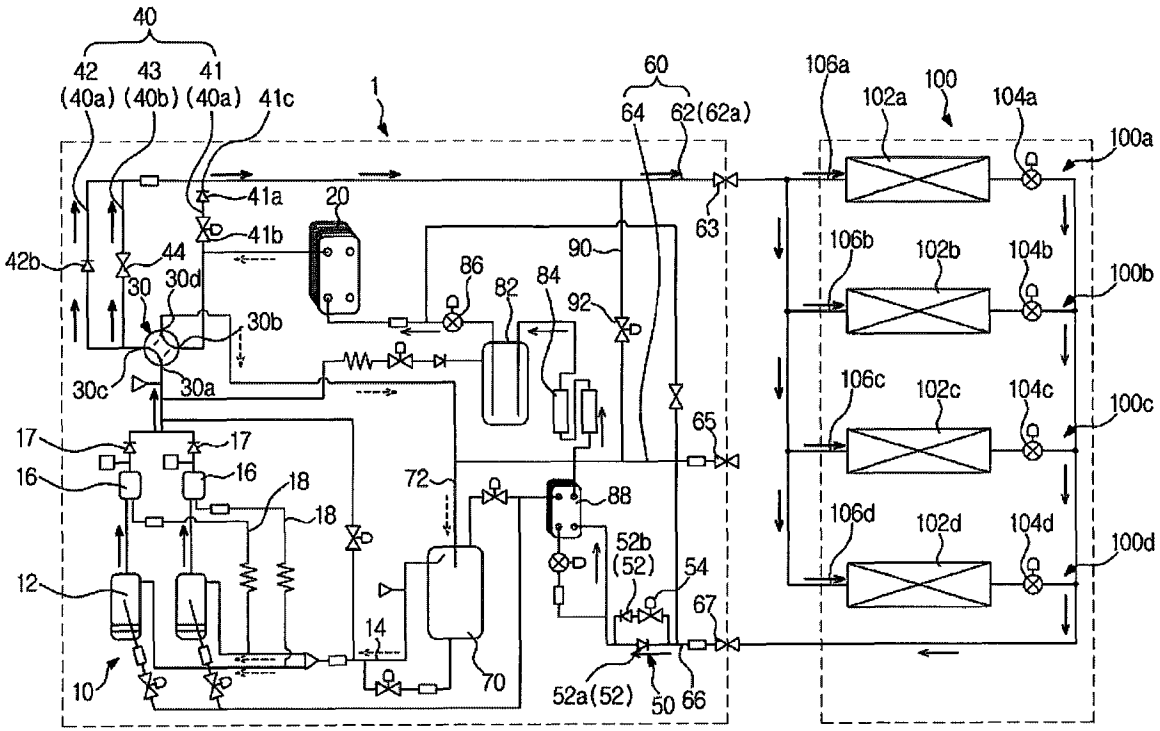

AIR CONDITIONER WITH USER CONTROL BETWEEN SIMULTANEOUS HEATING AND COOLING OPERATION AND ALTERNATING HEATING AND COOLING OPERATION

TECHNICAL FIELD

The present invention relates to an air conditioner, and more particularly, an air conditioner capable of being applied to various types.

BACKGROUND ART

The present invention relates to an air conditioner having a plurality of indoor units are provided such that the air conditioner is capable of converting a simultaneous operation of cooling and heating or a switching operation of cooling and heating upon a user's request.

Conventional simultaneous cooling and heating type air conditioners include a compressor, an outdoor heat exchanger, a four-way valve, one outdoor unit with an expansion valve, indoor units, a distributor including opening and closing valves, and a high pressure gas pipe, a low pressure gas pipe and a high pressure liquid line which are provided between the outdoor unit and indoor units.

Such simultaneous cooling and heating type air conditioners perform, by selectively opening and closing the opening and closing valves of the distributor, an all indoor units heating operation in which all of the indoor unit heats, an all indoor units cooling operation in which all of the indoor units cool, a heating-oriented operation in which a few indoor units perform a cooling operation and the rest of the indoor units perform a heating operation, and a cooling-oriented operation in which a few indoor units heat and the rest of the indoor units cool.

In addition, cooling and heating switching type air conditioners include a compressor, an outdoor heat exchanger, a four-way valve, one outdoor unit with an expansion valve, indoor units, and a gas pipe and a liquid line provided between the outdoor unit and the indoor units.

Such cooling and heating switching type air conditioners perform, by switching the flow of a refrigerant with the four-way valve, an all indoor units heating operation in which all of the indoor units heat, an all indoor units cooling operation in which all of the indoor units cool.

DISCLOSURE

Technical Problem

Since the outdoor unit of a simultaneous cooling and heating type air conditioner and the outdoor unit of a cooling and heating switching type air conditioner are not compatible with each other due to different internal configurations, there is a problem in that, when a type is changed between the simultaneous cooling and heating type air conditioner and the cooling and heating switching type air conditioner, the outdoor unit also needs to be changed.

Technical Solution

An air conditioner in accordance with the spirit of the present invention includes: an outdoor unit having an outdoor heat exchanger and a compressor installed therein; a plurality of indoor units which are connected to the outdoor unit and include an indoor heat exchanger installed therein; a four-way valve provided on the discharge part side of the compressor; a refrigerant tube having first to third refrigerant tubes and configured to connect the four-way valve and the indoor heat exchanger, in which the first refrigerant tube is branched between the four-way valve and the outdoor heat exchanger such that some of a refrigerant discharged from the compressor is fed into the indoor heat exchanger while bypassing the outdoor heat exchanger, the second refrigerant tube is connected to the four-way valve to feed all of a refrigerant discharged from the compressor into the indoor heat exchanger, and the third refrigerant tube is connected to the second refrigerant tube in parallel; and a heat pump valve provided at the third refrigerant tube to selectively close the third refrigerant tube.

The opening and closing of the heat pump valve may be controlled in accordance with operation methods of the plurality of indoor units.

The air conditioner may further include a distributor disposed between the outdoor unit and the plurality of indoor units to distribute a refrigerant such that each of the plurality of indoor units perform a cooling or heating operation at the same time. The heat pump valve may be closed when the air conditioner is operating.

The outdoor unit and the plurality of indoor units may be directly connected such that all of the plurality of indoor units to perform a cooling or heating operation at the same time. The heat pump valve may be open when the air conditioner is operating.

The refrigerant discharged from the compressor may alternatively flow into any one of the first refrigerant tube and the second refrigerant tube when the heat pump valve is closed.

The refrigerant discharged from the compressor or passed through the indoor heat exchanger may flow into at least any one of the second refrigerant tube and the third refrigerant tube when the heat pump valve is open.

The air conditioner may further include a gas pipe through which the refrigerant flows between the outdoor unit and the plurality of indoor units. Each of the first refrigerant tube, the second refrigerant tube, and the third refrigerant tube may have one end communicating with the gas pipe.

The gas pipe may include a high pressure gas pipe through which a high pressure refrigerant flows and a low pressure gas pipe through which a low pressure refrigerant flows.

The first refrigerant tube, the second refrigerant tube, and the third refrigerant tube may communicate with the high pressure gas pipe.

The first refrigerant tube may include a check valve for preventing backflow and an opening and closing valve which closes the first refrigerant tube.

The opening and closing valve may be closed to allow the plurality of indoor units to perform all cooling or all heating, and the heat pump valve may be open to allow bidirectional refrigerant movement in the third refrigerant tube.

The four-way valve may include a first port connected to a discharge part of the compressor, a second port which communicates with the first refrigerant tube and the outdoor heat exchanger, and a third port which communicates with the second refrigerant tube and the third refrigerant tube.

The second refrigerant tube may include a check valve for preventing backflow.

The heat pump valve may be a manual opening and closing valve, a solenoid valve or an electronic expansion valve.

The outdoor unit of an air conditioner in accordance with the spirit of the present invention having a plurality of indoor units, includes a compressor for compressing refrigerant; an outdoor heat exchanger for heat-exchanging with refrigerant; a four-way valve provided on the discharge part side of the compressor; a high pressure gas pipe which guides a refrigerant between the indoor unit and the pipe and through which a high pressure gas is guided, a low pressure gas pipe through which a low pressure gas is guided, and a liquid line which guides a liquid refrigerant; a high pressure gas service valve and a low pressure gas service valve respectively provided in the outdoor unit to open and close the high pressure gas pipe and the low pressure gas pipe; and a refrigerant tube provided between the high pressure gas service valve and the four-way valve, including a simultaneous type refrigerant tube for guiding a refrigerant discharged from the compressor to the high pressure gas pipe in one direction through the four-way valve and a switching type refrigerant tube provided for allowing a refrigerant to move bidirectionally between the compressor and the indoor unit.

The outdoor unit may further include a heat pump valve provided at the switching type refrigerant tube and capable of opening and closing the switching type refrigerant tube.

The simultaneous type refrigerant tube and the switching type refrigerant tube may be connected in parallel between the four-way valve and the high pressure gas pipe.

The opening and closing of the heat pump valve and opening and closing of the low pressure gas service valve may be conversely performed.

In the outdoor unit which is applied to a simultaneous cooling and heating type air conditioning system having a distributor to distribute a refrigerant such that each of the plurality of indoor units perform the cooling or heating operation at the same time, the heat pump valve may be closed.

In the outdoor unit which is applied to a cooling and heating switching type air conditioning system in which all of the plurality of indoor units perform the cooling or heating operation at the same time, the heat pump valve may be open and the low pressure service valve may be closed.

Advantageous Effects

An air conditioner of the present invention includes one outdoor unit 1 and is capable of being applied to both a simultaneous cooling and heating type air conditioner and a cooling and heating switching type air conditioner, thereby flexibly responding to the purpose of use.

DESCRIPTION OF DRAWINGS

FIG. 1 is a piping diagram of an air conditioner according to an exemplary embodiment of the present invention.

FIGS. 2 and 3 are refrigerant flow diagrams of an air conditioner according to an exemplary embodiment of the present invention.

FIG. 4 is a piping diagram of an air conditioner according to another exemplary embodiment of the present invention.

FIGS. 5 and 6 are refrigerant flow diagrams of an air conditioner according to another exemplary embodiment of the present invention.

MODES OF THE INVENTION

As used in the present specification, an all indoor units cooling operation indicates that all of a plurality of indoor units 100*a*, 100*b*, 100*c*, and 100*d* (hereinafter, all of the plurality of indoor units are identified by reference numeral 100) perform a cooling operation while an all indoor units heating operation indicates that all of the plurality of indoor units 100 perform a heating operation. Also, a cooling-oriented operation indicates that some of the plurality of indoor units 100 perform a cooling operation while the others perform a heating operation, a total cooling load of the indoor unit 100 is greater than a total heating load, and a four-way valve of an outdoor unit is in a cooling state. Furthermore, a heating-oriented operation indicates that some of the plurality of indoor units 100 perform a cooling operation while the others perform a heating operation, a total heating load of the indoor unit 100 is greater than a total cooling load, and a four-way valve of the outdoor unit is in a heating mode.

A simultaneous cooling and heating type air conditioner is an air conditioner provided for not only performing a cooling-oriented operation and a heating-oriented operation but also performing an all indoor units cooling operation and an all indoor units heating operation.

A cooling and heating switching type air conditioner is capable of performing an all indoor units cooling operation and an all indoor units heating operation.

Exemplary embodiments of the present invention will be described hereafter in detail with reference to the accompanying drawings.

FIG. 1 illustrates a piping diagram of an air conditioner according to an exemplary embodiment of the present invention.

Referring to FIG. 1, an air conditioner according to the present invention includes a plurality of indoor units 100 and at least one outdoor unit 1.

Also, in this exemplary embodiment, since the outdoor unit 1 is applied to a simultaneous cooling and heating type air conditioner, a distributor 120 connecting to the plurality of indoor units 100 and at least one outdoor unit 1 may be further included.

The plurality of indoor units 100 respectively include indoor heat exchangers 102*a*, 102*b*, 102*c*, and 102*d* which cool and heat indoor air while a refrigerant and the indoor air are heat-exchanging, and indoor expansion devices 104*a*, 104*b*, 104*c*, and 104*d* for expanding the refrigerant flowing toward the indoor heat exchangers 102*a*, 102*b*, 102*c*, and 102*d*.

The indoor expansion devices 104*a*, 104*b*, 104*c*, and 104*d* may be an electronic expansion valve (EEV) capable of controlling the flow of the refrigerant. The electronic expansion valve may control flow of refrigerant by adjusting opening degree.

Each of the indoor heat exchangers 102*a*, 102*b*, 102*c*, and 102*d* of the plurality of indoor units 100 is connected by indoor unit tubes 106*a*, 106*b*, 106*c*, and 106*d* in a relation with the distributor 120, and each of the indoor expansion devices 104*a*, 104*b*, 104*c*, and 104*d* thereof is connected by indoor liquid lines 108*a*, 108*b*, 108*c*, and 108*d* in a relation with the distributor 120.

The at least one outdoor unit 1 includes a compression part 10, an outdoor heat exchanger 20, an outdoor expansion device 50, and a four-way valve 30. Hereinafter, an example having one outdoor unit 1 will be described.

The compression part 10 includes one or more compressors 12 for compressing the refrigerant. Hereinafter, the compression part 10 is described to include a plurality of compressors 12. The plurality of compressors 12 may be disposed in parallel. Discharge flow paths of the plurality of compressors 12 are connected to the four-way valve 30, and an accumulator 70 is installed on an inflow path.

The accumulator 70 connected to the plurality of compressors 12 accumulates a liquid refrigerant and allows a gaseous refrigerant to be sucked into the plurality of compressors 12. A compressor inflow tube 14 for connecting the plurality of compressors 12 and the accumulator 70 is provided therebetween, and an accumulator inflow tube 72 for connecting the accumulator 70 and the four-way valve 30 is provided therebetween.

On the discharge flow paths of the plurality of compressors 12, oil separators 16 for separating the refrigerant and oil, check valves 17 for preventing the backflow of a refrigerant, and the four-way valve 30 are installed.

At the oil separator 16, an oil recovery path 18 is connected for recovering the oil separated from the refrigerant in the oil separator 16 in the compressor inflow tube 14.

In the outdoor unit 1, the refrigerant is guided through a gas pipe 60 and a liquid line 66 between the outdoor unit 1 and the distributor 120. The gas pipe 60 includes a high pressure gas pipe 62 in which high pressure gas is guided and a low pressure gas pipe 64 in which low pressure gas is guided. In the liquid line 66, a liquid refrigerant flows. Also, in the outdoor unit 1, a high pressure gas service valve 63 and a low pressure gas service valve 65 are respectively provided for adjusting the opening degree or opening and closing the high pressure gas pipe 62 and the low pressure gas pipe 64, and a liquid line service valve 67 is provided for adjusting the opening degree or opening and closing the liquid line 66.

An outdoor heat exchanger 20 functions as a condenser during the all indoor units cooling operation or a cooling-oriented operation, and functions as an evaporator during an all indoor units heating operation or a heating-oriented operation. The refrigerant inside the outdoor heat exchanger 20 is capable of heat-exchanging with outdoor air as a circulating fluid.

The outdoor expansion device 50 does not expand a refrigerant when the refrigerant passed through the outdoor heat exchanger 20 is passing, but expands a refrigerant when the refrigerant not passed through the outdoor heat exchanger 20 is passing.

The outdoor expansion device 50 may be disposed between the outdoor heat exchanger 20 and the distributor 120, and may include an outdoor expansion valve 54 and an outdoor check valve 52. In the exemplary embodiment of the present invention, an outdoor check valve 52 for preventing backflow may be provided at a refrigerant flow path for a refrigerant flowing from the outdoor heat exchanger 20 to the distributor 120, and an outdoor check valve 52 for preventing backflow and the outdoor expansion valve 54 may be provided at a refrigerant flow path for a refrigerant flowing from the distributor 120 to the outdoor heat exchanger 20. When the former is a first outdoor check valve 52*a* and the latter is a second outdoor check valve 52*b*, the first outdoor check valve 52*a* may be disposed in parallel with the second outdoor check valve 52*b* and the outdoor expansion valve 54. The outdoor expansion valve 54 may be, for example, an electronic expansion valve (EEV).

The four-way valve 30 is provided on the discharge part side of the compressor 12. The four-way valve 30 allows the refrigerant compressed in the plurality of compressors 12 to flow into the outdoor heat exchanger 20 when an all indoor units cooling operation or a cooling-oriented operation is performed, and allows the refrigerant passed through the outdoor heat exchanger 20 to flow toward the compressors 12 when an all indoor units heating operation or a heating-oriented operation is performed.

In the four-way valve 30 of the outdoor unit 1, a first port 30*a* is connected on the discharge side of the compressors 12 through an oil separator 16, and a second port 30*b* communicates with the high pressure gas pipe 62 through a first refrigerant tube 41, and, at the same time, is connected to the liquid line 66 through the outdoor heat exchanger 20 and the outdoor expansion device 50. Also, a third port 30*c* communicates with the high pressure gas pipe 62 through a second refrigerant tube 42 and a third refrigerant tube 43, and a fourth port 30*d* is connected to the accumulator 70.

A refrigerant tube 40 communicating with the four-way valve 30 may include the first refrigerant tube 41, the second refrigerant tube 42, and the third refrigerant tube 43.

The first refrigerant tube 41 is branched between the second port 30*b* and the outdoor heat exchanger 20 and is connected to the high pressure gas pipe 62. The first refrigerant tube 41 may be provided to be branched between the four-way valve 30 and the indoor heat exchangers 102*a*, 102*b*, 102*c*, and 102*d* such that some of the refrigerant discharged from the compressor 12 bypasses the outdoor heat exchanger 20 and is fed into the indoor heat exchangers 102*a*, 102*b*, 102*c*, and 102*d*. The rest of the refrigerant except some of the refrigerant fed to the first refrigerant tube 41 flow into the outdoor heat exchanger 20.

The first refrigerant tube 41 may include an opening and closing valve 41*a* for opening and closing the first refrigerant tube 41 and a check valve 41*b* for preventing the backflow of a refrigerant from the high pressure gas pipe 62. By controlling the former valve, a quantity of a refrigerant flowing into the high pressure gas pipe 62 through the first refrigerant tube 41 and a quantity of the refrigerant flowing into the outdoor heat exchanger 20 may be adjusted.

The second refrigerant tube 42 is connected to the third port 30*c* and communicates with the high pressure gas pipe 62. In detail, one end is connected to a connecting part 41*c* of the high pressure gas pipe 62 and the first refrigerant tube 41, and the other end is connected to the third port 30*c*.

The second refrigerant tube 42 is controlled such that all of the refrigerants discharged from the compressors 12 pass through the high pressure gas pipe 62. By controlling the four-way valve 30, a refrigerant separately flows into the first refrigerant tube 41 and outdoor heat exchanger 20, or all of the refrigerants are capable of flowing through the second refrigerant tube 42. The second refrigerant tube 42 may include a check valve 42*b* which prevents backflow from the high pressure gas pipe 62 side.

The third refrigerant tube 43 is provided to be branched from the second refrigerant tube 42. In other words, the third refrigerant tube 43 may be disposed to be connected to the second refrigerant tube 42 in parallel.

In detail, one end and the other end thereof communicate with the second refrigerant tube 42, and a heat pump valve 44 may be provided to be connected to the check valve 42*a* of the second refrigerant tube 42 in parallel.

The heat pump valve 44 is provided so as to be capable of opening and closing the third refrigerant tube 43. The opening and closing of the heat pump valve 44 is differently controlled depending on the operation methods of the plurality of indoor units 100. As described hereafter, when applied to a simultaneous cooling and heating type air conditioner, the heat pump valve 44 is closed, and when applied to a cooling and heating switching type air conditioner, the heat pump valve 44 is open. The heat pump valve 44 may be composed of a manual opening, a closing valve, a solenoid valve or an electronic expansion valve.

In the simultaneous cooling and heating type air conditioner, regardless of cooling and heating, the refrigerant discharged from the compressor 12 and flowed to the high pressure gas pipe 62 through the first refrigerant tube 41 or the second refrigerant tube 42 is delivered into the indoor unit 100 via the distributor 120, thereby, a configuration for guiding the refrigerant in the backflow direction is not needed.

However, when cooling operation is performed with the cooling and heating switching type air conditioner without the distributor 120, a refrigerant passes through the compressor 12 and the outdoor heat exchanger 20, moves in the backflow direction of the high pressure gas pipe 62. At this time, the refrigerant passes the four-way valve 30 through the third refrigerant tube 43, and thus flows into the compressor 12.

That is, since the third refrigerant tube 43 is not used in the simultaneous cooling and heating type air conditioner, it can be closed using the heat pump valve 44. In the cooling and heating switching type air conditioner, by opening the heat pump valve 44, a refrigerant flowing bidirectionally depending on the cooling and heating operation may be guided.

One end each of the first refrigerant tube 41, the second refrigerant tube 42, and the third refrigerant tube 43 are provided to communicate with the high pressure gas pipe 62. Also, since the first refrigerant tube 41 and the second refrigerant tube 42 are active when the outdoor unit 1 of the present invention is applied to the simultaneous cooling and heating type air conditioner, the first refrigerant tube 41 and the second refrigerant tube 42 may be a simultaneous type refrigerant tube 40*a*. In addition, since the third refrigerant tube 43 is active when the outdoor unit 1 of the present invention is applied to the cooling and heating switching type air conditioner, the third refrigerant tube 43 may be a switching type refrigerant tube 40*b*. The simultaneous type refrigerant tube 40*a* and the switching type refrigerant tube 40*b* may be connected between the four-way valve 30 and the high pressure gas pipe 62 in parallel.

The outdoor unit 1 may further include a receiver 82, a refrigerant cooler 84, an outdoor heat exchanger valve 86, and a supercooling device 88.

The refrigerant cooler 84 circulates a refrigerant to dissipate the heat of an inverter controller and functions as a heat sink of the inverter controller.

The outdoor heat exchanger valve 86, as a configuration for controlling a quantity of the refrigerant flowing into the outdoor heat exchanger 20, may be provided between the receiver 82 and the outdoor heat exchanger 20.

The supercooling device 88 is capable of securing a degree of supercooling of the refrigerant fed into the indoor unit 100 when a cooling operation is performed, and may be provided between the outdoor heat exchanger 20 and the outdoor expansion device 50.

In the outdoor unit 1, a bypass channel 90 is connected between the high pressure gas pipe 62 and the low pressure gas pipe 64, and the bypass channel 90 has an opening and closing valve for controlling pressure 92. In a heating-oriented operation, when the opening and closing valve for controlling pressure 92 is open, some of the refrigerant flowing through the high pressure gas pipe 62 passes through the bypass channel 90 and is merged with the refrigerant flowing through the low pressure gas pipe 64, and thus the pressure in the low pressure gas pipe 64 increases.

The distributor 120 is connected to the plurality of indoor units 100 and the outdoor unit 1 to control the flow of a refrigerant. The distributor 120 is connected to the indoor unit 100 through the indoor unit tubes 106*a*, 106*b*, 106*c*, and 106*d* and the indoor liquid lines 108*a*, 108*b*, 108*c*, and 108*d*, and is connected to the outdoor unit 1 through the high pressure gas pipe 62, the liquid line 66, and the low pressure gas pipe 64.

The high pressure gas pipe 62, the low pressure gas pipe 64, and the liquid line 66 may be branched in the distributor 120, and the branched liquid lines 66 are respectively connected to the indoor expansion devices 104*a*, 104*b*, 104*c*, and 104*d*. Also, the high pressure gas pipe 62 and the low pressure gas pipe 64 are respectively connected to the heat exchangers 102*a*, 102*b*, 102*c*, and 102*d* of the indoor unit 100 through heating valves 122*a*, 122*b*, 122*c*, and 122*d* and cooling valves 124*a*, 124*b*, 124*c*, and 124*d* in the distributor 120. While the inflow sides of the heating valves 122*a*, 122*b*, 122*c*, and 122*d* are joined to communicate with the high pressure gas pipe 62, the outlet sides thereof communicate with the respective indoor heat exchangers 102*a*, 102*b*, 102*c*, and 102*d* of the indoor unit 100. While the inflow sides of the cooling valves 124*a*, 124*b*, 124*c*, and 124*d* communicate with the respective indoor heat exchangers 102*a*, 102*b*, 102*c*, and 102*d* of the indoor unit 100, the outlet sides thereof are joined and communicate with the low pressure gas pipe 64.

As shown in FIG. 2, when the indoor unit 100 connected to the indoor unit tubes 106*a* and 106*b* performs a cooling operation, the cooling valves 124*a* and 124*b* may be open and the heating valves 122*a* and 122*b* may be closed. When the indoor unit 100 connected to the indoor unit tubes 106*c* and 106*d* performs a heating operation, the cooling valve 124*c* and 124*d* may be closed and the heating valves 122*c* and 122*d* may be open. In the present invention, the cooling valves 124*a*, 124*b*, 124*c*, and 124*d* and the heating valves 122*a*, 122*b*, 122*c*, and 122*d* may be an electronic expansion valve (EEV) capable of adjusting the opening degree linearly or by stages.

Hereinafter, operations of an air conditioner will be described.

First, a heating-oriented operation will be described.

In a simultaneous cooling and heating type air conditioner, the heat pump valve 44 of the outdoor unit 1 is closed to flow a refrigerant into the first refrigerant tube 41 or the second refrigerant tube 42, and the low pressure gas service valve 65 of the outdoor unit 1 is open. As described hereinafter, in a cooling and heating switching type air conditioner, the heat pump valve 44 is open and the low pressure gas service valve 65 is closed. That is, the opening and closing of the heat pump valve 44 and the low pressure gas service valve 65 are conversely performed.

The outdoor unit 1 of the present invention applied to the simultaneous cooling and heating type air conditioner is provided such that the refrigerant discharged from the compressor 12 after closing the heat pump valve 44 alternatively flows into any one of the first refrigerant tube 41 or the second refrigerant tube 42.

FIG. 2 is a refrigerant flow diagram of an air conditioner according to an exemplary embodiment of the present invention. FIG. 2 is a refrigerant flow diagram showing a heating-oriented operation performed by a cooling and heating simultaneous type air conditioner.

Thick arrows in the drawing indicate the flow of a high pressure refrigerant gas, arrows with dotted lines indicate the flow of a low pressure refrigerant gas, and thin arrows indicate flow of a liquid refrigerant.

When the heating-oriented operation is performed, in a heating operation, the cooling valves 124*c* and 124*d* installed in the indoor units 100*c* and 100*d* are closed, and the heating valves 122*c* and 122*d* are open. On the other hand, in a cooling operation, the cooling valves 124*a* and 124*b* installed in the indoor units 100*a* and 100*b* are open, and the heating valves 122*a* and 122*b* are closed.

When the heating-oriented operation is performed, a refrigerant compressed in the plurality of compressors 12 flows from the outdoor unit 1 to the distributor 120 via the second refrigerant tube 42 and the high pressure gas pipe 62, and then, is condensed in the indoor heat exchangers 102*c* and 102*d* of the indoor units 100*c* and 100*d* via the indoor unit tubes 106*c* and 106*d*. The condensed refrigerant passes the indoor expansion devices 104*c* and 104*d* without expansion and flows through the indoor liquid lines 108*c* and 108*d* in the indoor units 100*c* and 100*d*.

Some of the refrigerant flowing in the liquid lines 108*c* and 108*d* flows into the indoor expansion devices 104*a* and 104*b* of the indoor units 100*a* and 100*b* in a cooling operation through the indoor liquid lines 108*a* and 108*b* connected to the indoor units 100*a* and 100*b* in the cooling operation and expanded therein. The expanded refrigerant is evaporated in the indoor heat exchangers 102*a* and 102*b* of the indoor units 100*a* and 100*b* in the cooling operation, and then, passes through the low pressure gas pipe 64 via the indoor unit tubes 106*a* and 106*b*, and is sucked into the plurality of compressors 12.

The rest of the refrigerant flowing in the indoor liquid lines 108*c* and 108*d* is fed into the outdoor expansion device 50 of the outdoor unit 1 through the liquid line 66 and expanded therein, then, is fed into the four-way valve 30 after being evaporated in the outdoor heat exchanger 20, and sucked into the plurality of compressors 12.

Next, a cooling-oriented operation will be described hereafter.

FIG. 3 is a refrigerant flow diagram of an air conditioner according to an exemplary embodiment of the present invention. FIG. 3 is a refrigerant flow diagram showing a cooling-oriented operation performed by a simultaneous cooling and heating type air conditioner.

When the cooling-oriented operation is performed, in a heating operation, the cooling valves 124*c* and 124*d* installed in the indoor units 100*c* and 100*d* are closed, and the heating valves 122*c* and 122*d* are open. On the other hand, in a cooling operation, the cooling valves 124*a* and 124*b* installed in the indoor unit 100*a* and 100*b* are open, and the heating valves 122*a* and 122*b* are closed.

When the cooling-oriented operation is performed, the four-way valve 30 connects the first port 30*a* and the second port 30*b*.

Therefore, a refrigerant compressed in the plurality of compressors 12 flows from the first port 30*a* to the second port 30*b*, some of the refrigerant flows into the high pressure gas pipe 62 through the first refrigerant tube 41, the rest of the refrigerant passes through the outdoor heat exchanger 20 and is fed into the indoor expansion devices 104*a* and 104*b* of the indoor units 100*a* and 100*b* in a cooling operation via the liquid line 66, and the refrigerant fed into the indoor expansion devices 104*a* and 104*b* is expanded in the indoor expansion devices 104*a* and 104*b*, and then, is evaporated in the indoor heat exchangers 102*a* and 102*b*. The evaporated refrigerant is then sent from the indoor units 100*a* and 100*b* in the cooling operation to the accumulator 70 through the indoor unit tubes 106*a* and 106*b* and the low pressure gas pipe 64, and then, compressed in the plurality of compressors 12.

Meanwhile, the refrigerant flowing into the high pressure gas pipe 62 through the first refrigerant tube 41 flows into the distributor 120 through the high pressure gas pipe 62, passes through the heating valves 122*c* and 122*d*, flows into the indoor heat exchangers 102*c* and 102*d* of the indoor units 100*c* and 100*d* in the heating operation, and condensed therein. The condensed refrigerant then passes through the indoor expansion devices 104*c* and 104*d* without expansion and is mixed with the refrigerant fed into the indoor expansion devices 104*a* and 104*b* of the indoor units 100*a* and 100*b* in the cooling operation through the liquid line 66. Then, as described above, the refrigerant is fed to the indoor expansion devices 104*a* and 104*b* of the indoor units 100*a* and 100*b* in the cooling operation through the indoor liquid lines 108*a* and 108*b* of the indoor units 100*a* and 100*b* in the cooling operation or is fed to the outdoor unit side.

When the refrigerant flows as above, the indoor heat exchangers 102*a* and 102*b* of the indoor units 100*a* and 100*b* in the cooling operation function as evaporators to cool an internal space, and the indoor heat exchangers 102*c* and 102*d* of the indoor units 100*c* and 100*d* in the heating operation function as condensers to heat the internal space.

FIG. 4 is a piping diagram of an air conditioner according to another exemplary embodiment of the present invention. FIGS. 4, 5, and 6 are drawings related to a cooling and heating switching type air conditioner.

The cooling and heating switching type air conditioner includes the plurality of indoor units 100 as described above and at least one outdoor unit 1.

Since the cooling and heating switching type air conditioner has a configuration in which the distributor 120 is omitted from the simultaneous cooling and heating type air conditioner, the descriptions related to the repetitive configurations are omitted. Unlike the simultaneous cooling and heating type air conditioner, in the cooling and heating switching type air conditioner, the indoor unit 100 and the outdoor unit 1 are directly connected through pipes.

The outdoor unit 1 of the present invention applied to the cooling and heating switching type air conditioner is connected to the plurality of indoor units 100 by closing the low pressure gas pipe 64 and opening the heat pump valve 44.

When the low pressure gas pipe 64 is closed, the high pressure gas pipe 62 serves as the refrigerant gas pipe 62*a* in the cooling and heating switching type air conditioner.

Each of the indoor heat exchangers 102*a*, 102*b*, 102*c*, and 102*d* of the plurality of indoor units 100 is connected to the gas pipe 60 through the indoor unit tubes 106*a*, 106*b*, 106*c*, and 106*d*. Each of the indoor expansion devices 104*a*, 104*b*, 104*c*, and 104*d* is connected to the liquid line 66 through the indoor liquid lines 108*a*, 108*b*, 108*c*, and 108*d*.

The outdoor expansion device 50 may be provided between the outdoor heat exchanger 20 and the indoor unit 100 and may include the outdoor expansion valve 54 and an outdoor check valve 52.

In the exemplary embodiment of the present invention, an outdoor check valve 52 for preventing backflow may be provided at a refrigerant flow path for the refrigerant flowing from the outdoor heat exchanger 20 to the indoor unit 100, an outdoor check valve 52 for preventing backflow and the outdoor expansion valve 54 may be provided at a refrigerant flow path for the refrigerant flowing from the indoor unit 100 to the outdoor heat exchanger 20. When the former is a first outdoor check valve 52*a* and the latter is a second outdoor check valve 52*b*, the first outdoor check valve 52*a* may be disposed in parallel with the second outdoor check valve 52*b* and the outdoor expansion valve 54. The outdoor expansion valve 54 may be, for example, an electronic expansion valve (EEV).

Hereinafter, operations of an air conditioner according to another exemplary embodiment of the present invention will be described.

In the cooling and heating switching type air conditioner, the heat pump valve 44 of the outdoor unit 1 is open to allow the refrigerant to flow into the third refrigerant tube 43, and the low pressure gas service valve 65 of the outdoor unit 1 is closed.

In detail, in an all indoor units heating operation, the refrigerant discharged from the compressor 12 passes through the four-way valve 30 and flows into at least any one of the second refrigerant tube 42 and the third refrigerant tube 43 in one direction. In an all indoor units cooling operation, the refrigerant passed through the indoor heat exchangers 102*a*, 102*b*, 102*c*, and 102*d* flows into the third refrigerant tube 43 in the other direction.

First, an all indoor units heating operation will be described.

FIG. 5 is a refrigerant flow diagram of an air conditioner according to another exemplary embodiment of the present invention. FIG. 5 is a refrigerant flow diagram showing the all indoor units heating operation performed by a cooling and heating switching type air conditioner.

Referring to FIG. 5, when all of the indoor units 100 perform a heating operation, a refrigerant compressed in the plurality of compressors 12 passes through the indoor unit tubes 106*a*, 106*b*, 106*c*, and 106*d* via the third refrigerant tube 43 and the gas pipe 60 and is fed into the indoor heat exchangers 102*a*, 102*b*, 102*c*, and 102*d*. The refrigerant fed into the indoor heat exchangers 102*a*, 102*b*, 102*c*, and 102*d* is condensed, then, passes through the indoor expansion devices 104*a*, 104*b*, 104*c*, and 104*d* without expansion, and flows into the liquid line 66 through the indoor liquid lines 108*a*, 108*b*, 108*c*, and 108*d* in the indoor unit 100. The refrigerant flowed into the liquid line 66 is fed into the outdoor expansion device 50 of the outdoor unit 1 and expanded therein, and then, is evaporated in the outdoor heat exchanger 20, passes through the four-way valve 30, and then is flowed into the plurality of compressors 12.

Next, an all indoor units cooling operation will be described.

FIG. 6 is a refrigerant flow diagram of an air conditioner according to another exemplary embodiment of the present invention. FIG. 6 is a refrigerant flow diagram showing the all indoor units cooling operation performed by a cooling and heating switching type air conditioner.

Referring to FIG. 6, when all of the indoor units 100 perform a cooling operation, a refrigerant compressed in the plurality of compressors 12 passes through the four-way valve 30 and is fed into the outdoor heat exchanger 20. The refrigerant fed into the outdoor heat exchanger 20 is condensed, then, passes through the outdoor expansion device 50 without expansion, and flows into the indoor liquid lines 108*a*, 108*b*, 108*c*, and 108*d* in the indoor unit 100 via the liquid line 66. The refrigerant flowed into the indoor liquid lines 108*a*, 108*b*, 108*c*, and 108*d* is fed into the outdoor expansion device 50 of the indoor unit 100 and expanded therein, then, is evaporated in the indoor heat exchangers 102*a*, 102*b*, 102*c*, and 102*d*, and then, flows into the four-way valve 30 via the third refrigerant tube 43. The refrigerant passed through the four-way valve 30 is flowed into the plurality of compressors 12.

In the simultaneous cooling and heating type air conditioner, the cooling-oriented operation and the heating-oriented operation were described, but the all indoor units cooling operation may be performed by all of the indoor units 100 to maximize a cooling load in a cooling operation. On the other hand, the all indoor units heating operation may be performed by all of the indoor units 100 to maximize a heating load in a heating operation.

To avoid redundancy and describe a refrigerant flow depending on cooling and heating in the cooling and heating switching type air conditioner, the descriptions related to the all indoor units cooling operation and the all indoor units heating operation above were made only for the cooling and heating switching type air conditioner.

However, of course, the all indoor units cooling operation and the all indoor units heating operation may also be applied to the simultaneous cooling and heating type air conditioner.

In the above, the particular embodiments have been illustrated and described.

However, the present invention is not limited to one embodiment, and those of ordinary skill in the art to which the present invention pertains will be able to change and practice the present invention in various ways without departing from the technical spirit of the present invention described in the claims below.

The invention claimed is:

1. An air conditioner comprising:

an outdoor unit having an outdoor heat exchanger and a compressor installed therein, the compressor having a discharge side;

a four-way valve provided on the discharge side of the compressor;

a plurality of indoor units which are connected to the outdoor unit and include an indoor heat exchanger installed therein;

a gas pipe through which a refrigerant flows between the outdoor unit and the plurality of indoor units;

a refrigerant tube having first to third refrigerant tubes and configured to connect the four-way valve and the indoor heat exchanger, in which the first refrigerant tube is branched between the four-way valve and the outdoor heat exchanger such that some of the refrigerant discharged from the compressor is fed into the indoor heat exchanger while bypassing the outdoor heat exchanger, the second refrigerant tube is connected to the four-way valve to feed all of the refrigerant discharged from the compressor into the indoor heat exchanger, the second refrigerant tube further comprising a check valve for preventing backflow and the third refrigerant tube is connected to the four-way valve and connected to the second refrigerant tube in parallel at a point upstream of the check valve; and a heat pump valve provided at the third refrigerant tube to selectively close the third refrigerant tube, the heat pump valve selectively permitting bidirectional flow of refrigerant in the third refrigerant tube depending on whether the air conditioner is performing a heating or cooling operation.

2. The air conditioner of claim 1, wherein the heat pump valve is controlled in accordance with operation methods of the plurality of indoor units.

3. The air conditioner of claim 1, further comprising a distributor disposed between the outdoor unit and the plurality of indoor units to distribute the refrigerant such that each of the plurality of indoor units performs a cooling or heating operation at the same time, and wherein the heat pump valve is closed when the air conditioner is operating.

4. The air conditioner of claim 1, wherein the outdoor unit and the plurality of indoor units are directly connected such that all of the plurality of indoor units perform cooling or heating operation at the same time, and the heat pump valve is open when the air conditioner is operating.

5. The air conditioner of claim 1, wherein the refrigerant discharged from the compressor alternatively flows into any one of the first refrigerant tube and the second refrigerant tube when the heat pump valve is closed.

6. The air conditioner of claim 1, wherein the refrigerant discharged from the compressor or passed through the indoor heat exchanger flows into at least any one of the second refrigerant tube and the third refrigerant tube when the heat pump valve is open.

7. The air conditioner of claim 1, wherein each of the first refrigerant tube, the second refrigerant tube, and the third refrigerant tube has one end communicating with the gas pipe.

8. The air conditioner of claim 1, wherein the gas pipe comprises:

a high pressure gas pipe through which a high pressure refrigerant flows; and a low pressure gas pipe through which a low pressure refrigerant flows, wherein the first refrigerant tube, the second refrigerant tube, and the third refrigerant tube are communicated with the high pressure gas pipe.

9. The air conditioner of claim 1, wherein the first refrigerant tube comprises:

a check valve for preventing backflow; and an opening and closing valve which closes the first refrigerant tube.

10. The air conditioner of claim 9, wherein the opening and closing valve is closed to allow the plurality of indoor units to perform simultaneous cooling and heating.

11. The air conditioner of claim 1, wherein the four-way valve comprises:

a first port connected to a discharge part of the compressor;

a second port which communicates with the first refrigerant tube and the outdoor heat exchanger; and a third port which communicates with the second refrigerant tube and the third refrigerant tube.

12. The air conditioner of claim 1, wherein the heat pump valve is a manual opening and closing valve, a solenoid valve or an electronic expansion valve.

13. An outdoor unit of an air conditioner having a plurality of indoor units, comprising:

a compressor for compressing a refrigerant;

an outdoor heat exchanger for heat-exchanging with a refrigerant;

a four-way valve provided at a discharge part side of the compressor;

a high pressure gas pipe which guides a refrigerant between the plurality of indoor units and the outdoor unit and through which a high pressure gas is guided, a low pressure gas pipe through which a low pressure gas is guided, and a liquid line which guides a liquid refrigerant;

a high pressure gas service valve and a low pressure gas service valve respectively provided in the outdoor unit to open and close the high pressure gas pipe and the low pressure gas pipe; and a refrigerant tube provided between the high pressure gas service valve and the four-way valve, including a simultaneous type refrigerant tube for guiding a refrigerant discharged from the compressor to the high pressure gas pipe in one direction through the four-way valve, the simultaneous type refrigerant tube connected to the four-way valve, and a switching type refrigerant tube connected to the four-way valve, the switching type refrigerant tube provided for allowing a refrigerant to move bidirectionally between the compressor and the indoor unit wherein the simultaneous type refrigerant tube and the switching type refrigerant tube are connected in parallel between the four-way valve and the high pressure gas pipe at a point upstream of a check valve for preventing backflow in the simultaneous type refrigerant tube.

14. The outdoor unit of claim 13, further comprising a heat pump valve provided at the switching type refrigerant tube and capable of opening and closing the switching type refrigerant tube.

15. The outdoor unit of claim 14, wherein the opening and closing of the heat pump valve and the opening and closing of the low pressure gas service valve may be conversely performed.

16. The outdoor unit of claim 14, configured as a component of a simultaneous cooling and heating type air conditioning system having a distributor to distribute a refrigerant such that each of the plurality of indoor units perform a cooling or heating operation at the same time, wherein the heat pump valve is closed.

17. The outdoor unit of claim 14, configured as a component of a cooling and heating switching type air conditioning system in which all of the plurality of indoor units perform the cooling or heating operation at the same time, wherein the heat pump valve is open and the low pressure gas service valve is closed.

* * * * *